US005255802A

United States Patent [19]

Krinke et al.

[11] Patent Number: 5,255,802

[45] Date of Patent: Oct. 26, 1993

[54] MERCHANDISE DISPLAY SYSTEM

[75] Inventors: Wade H. Krinke, Marine-On-St. Croix; Richard A. Linn; Edward J. Goldstein, both of Minneapolis, all of Minn.

[73] Assignee: Padco, Incorporated, Minneapolis, Minn.

[21] Appl. No.: 966,581

[22] Filed: Oct. 26, 1992

Related U.S. Application Data

[63] Continuation of Ser. No. 673,730, Mar. 22, 1991, abandoned.

[51] Int. Cl.[5] ..... A47F 7/00

[52] U.S. Cl. ..... 211/184; 211/60.1

[58] Field of Search ..... 211/184, 59.2, 90, 74, 211/60.1, 43, 11; 108/60, 61

[56] References Cited

U.S. PATENT DOCUMENTS

| | | | |
|---|---|---|---|
| D. 289,586 | 5/1987 | Staab . | |
| 660,264 | 10/1900 | Storm . | |
| 673,200 | 4/1901 | Delbridge . | |
| 1,117,255 | 11/1914 | Schmidt | 211/184 X |
| 1,415,110 | 5/1922 | Pearl . | |
| 1,712,054 | 5/1929 | Sheard . | |
| 1,736,574 | 11/1929 | Binks . | |
| 1,921,222 | 8/1933 | De Lamar . | |
| 2,218,444 | 10/1940 | Vineyard | 211/59.2 |
| 2,222,974 | 11/1940 | Bow . | |
| 2,625,806 | 1/1953 | Kennedy . | |
| 2,934,214 | 4/1960 | Mogulescu et al. | 211/184 X |
| 2,934,215 | 4/1960 | Mogulescu et al. | 211/184 X |
| 3,160,283 | 12/1964 | Lachance | 211/184 |
| 3,455,462 | 7/1969 | Morgin . | |
| 4,476,985 | 10/1984 | Norberg et al. | 211/184 X |
| 4,476,986 | 10/1984 | Robinson . | |
| 4,552,272 | 11/1985 | Field | 211/184 X |
| 4,611,720 | 9/1986 | Staab | 211/60.1 |
| 4,759,449 | 7/1988 | Gold | 211/184 X |
| 4,858,774 | 8/1989 | Winter et al. | 211/184 |
| 4,901,869 | 2/1990 | Hawkinson et al. | 211/184 |

FOREIGN PATENT DOCUMENTS

| | | | |
|---|---|---|---|
| 0655044 | of 1965 | Belgium | 211/184 |

OTHER PUBLICATIONS

Consumers Price Sheet, Advance, Shelving Co., Inc. Sep. 1958.

Ser. No. 07/674,033 filed Mar. 22, 1991 to Krinke.

*Primary Examiner*—Blair M. Johnson

*Assistant Examiner*—Sarah Lechok

*Attorney, Agent, or Firm*—Merchant, Gould, Smith, Edell, Welter & Schmidt

[57] ABSTRACT

A merchandise display system is disclosed having a base member and back member joined together with said base member generally horizontal and said back member generally vertical. A plurality of divider receiving slots are formed in each of said base member and back member. A plurality of dividers are received within the slots. A forward edge of the base member slot is provided with a generally vertical wall. A lock is provided on each of the dividers to lock the divider to the forward wall upon insertion of the divider into the slots.

9 Claims, 8 Drawing Sheets

MERCHANDISE DISPLAY SYSTEM

This is a continuation of application Ser. No. 07/673,730, filed Mar. 22, 1991 now abandoned.

BACKGROUND OF THE INVENTION

1. Field of the Invention

This invention pertains to a merchandise display system for retail sales. More particularly, this invention pertains to a display system having a plurality of dividers carried on a base to organize displayed articles.

2. Description of the Prior Art

Merchandise display systems are well known. An example of one such system is shown in U.S. Pat. No. 4,611,720 to Staab, dated Sep. 16, 1986. That patent teaches a rack of a shell-type construction having a plurality of clear dividers retained within slots formed in the shell. The display rack of U.S. Pat. No. 4,611,720 also appears to be the subject matter of U.S. Pat. No. Design 289,586, dated May 5, 1987.

In designing a merchandise display system, it is desirable to fabricate the display system in a manner which is as inexpensive as possible while retaining aesthetic designs and enhancing functional features of the display. It is an object of the present invention to provide an improved merchandise display system.

SUMMARY OF THE INVENTION

According to a preferred embodiment of the present invention, a merchandise display system is provided having a base member with a first plurality of divider receiving slots formed therein. A back member is provided having a second plurality of divider receiving slots formed therein. The base member is connected to the back member with the first and second plurality of slots aligned to define a plurality of complete divider slots. A plurality of dividers having bottom and rear edges are disposed within the system with the rear edges received within the second plurality of slots and with the first edges received in the first plurality of slots. The base member has a plurality of vertical forward wall segments at the terminal end of each of the first plurality of slots. Each of the dividers has, at its forward edge, means for locking the divider to the base.

DESCRIPTION OF THE PREFERRED EMBODIMENT

Figure 1:
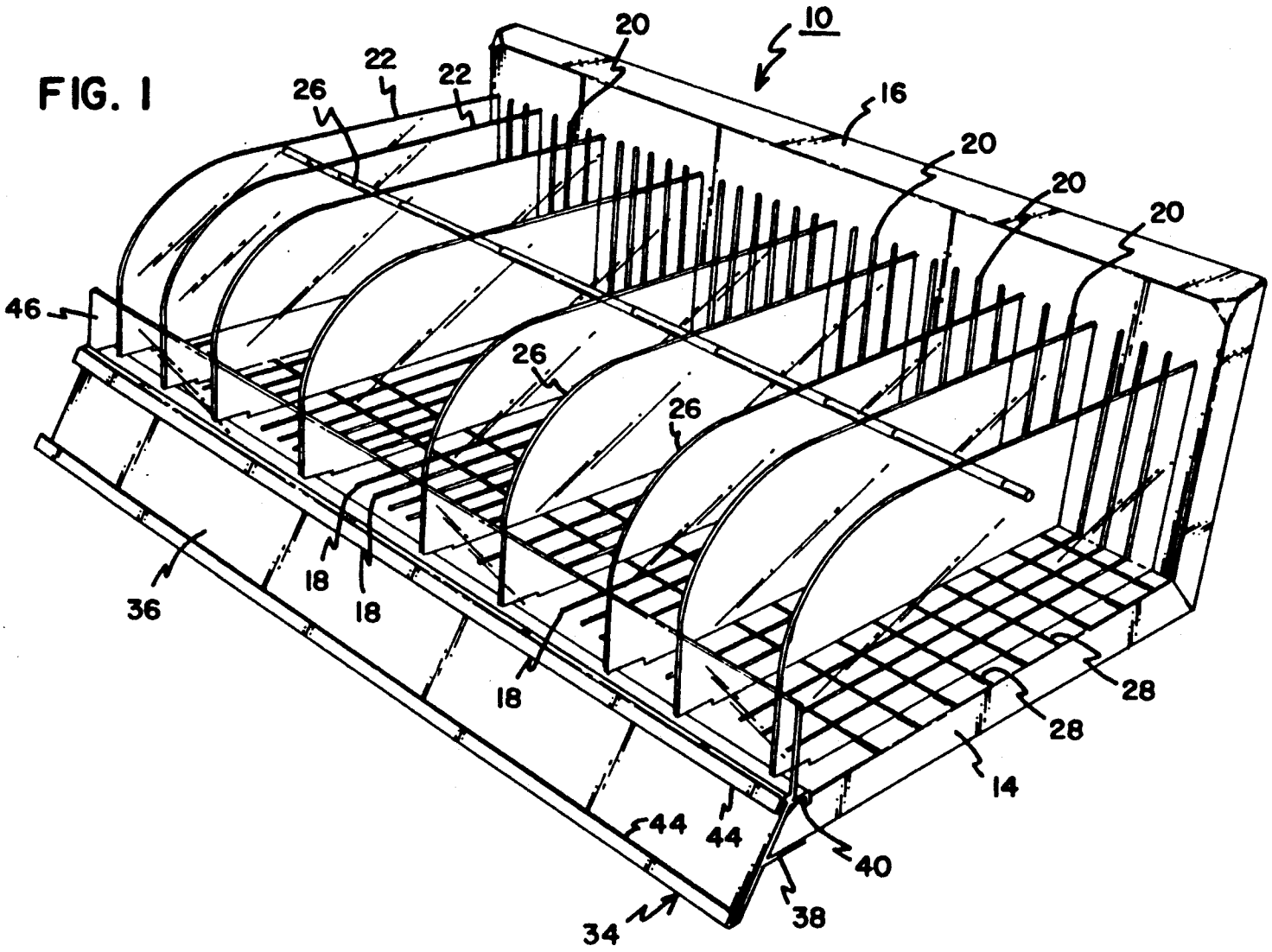
FIG. 1 is a front, top and right side perspective view of a merchandise display system according to the present invention.
Figure 2:
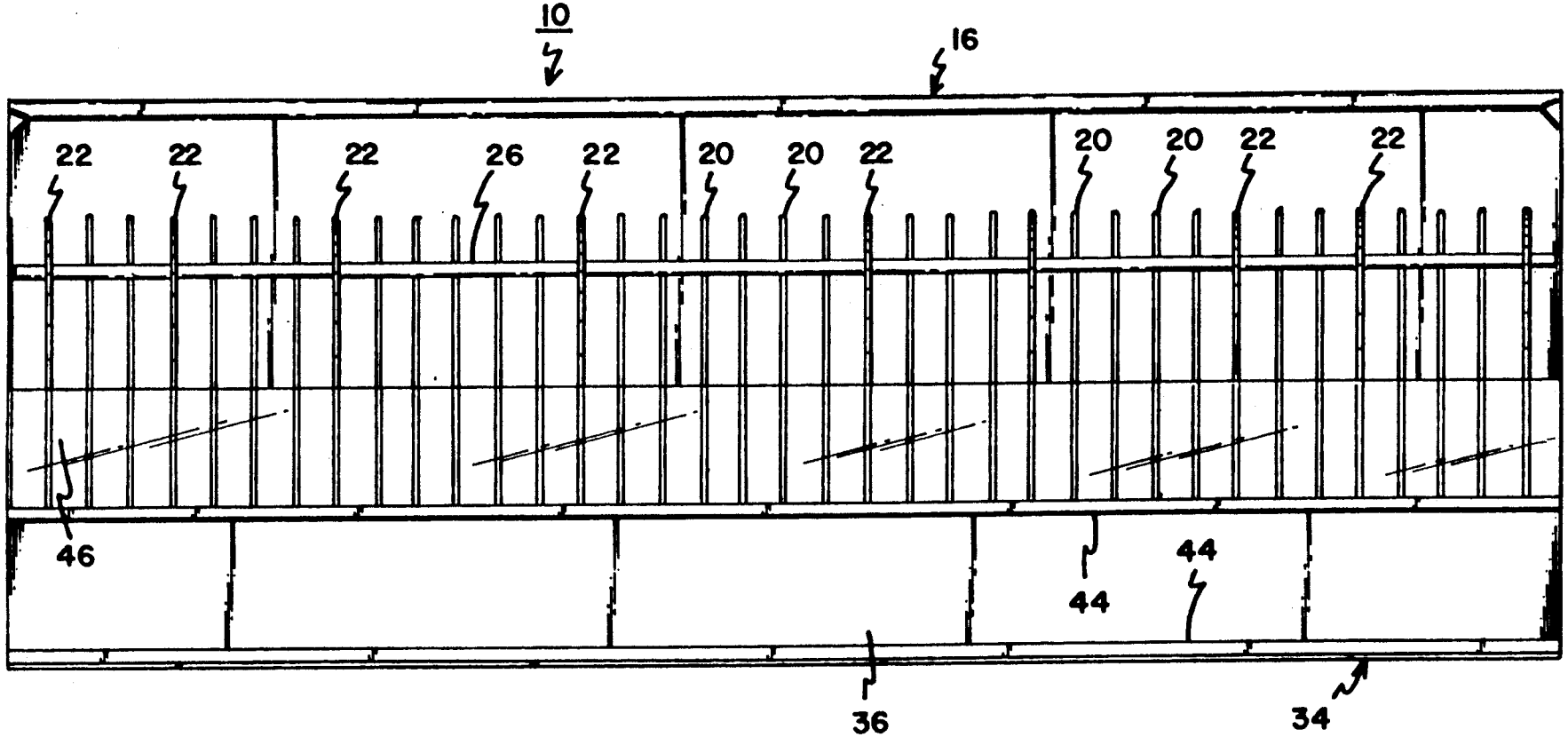
FIG. 2 is a front elevation view of the merchandise display system of FIG. 1.
Figure 3:
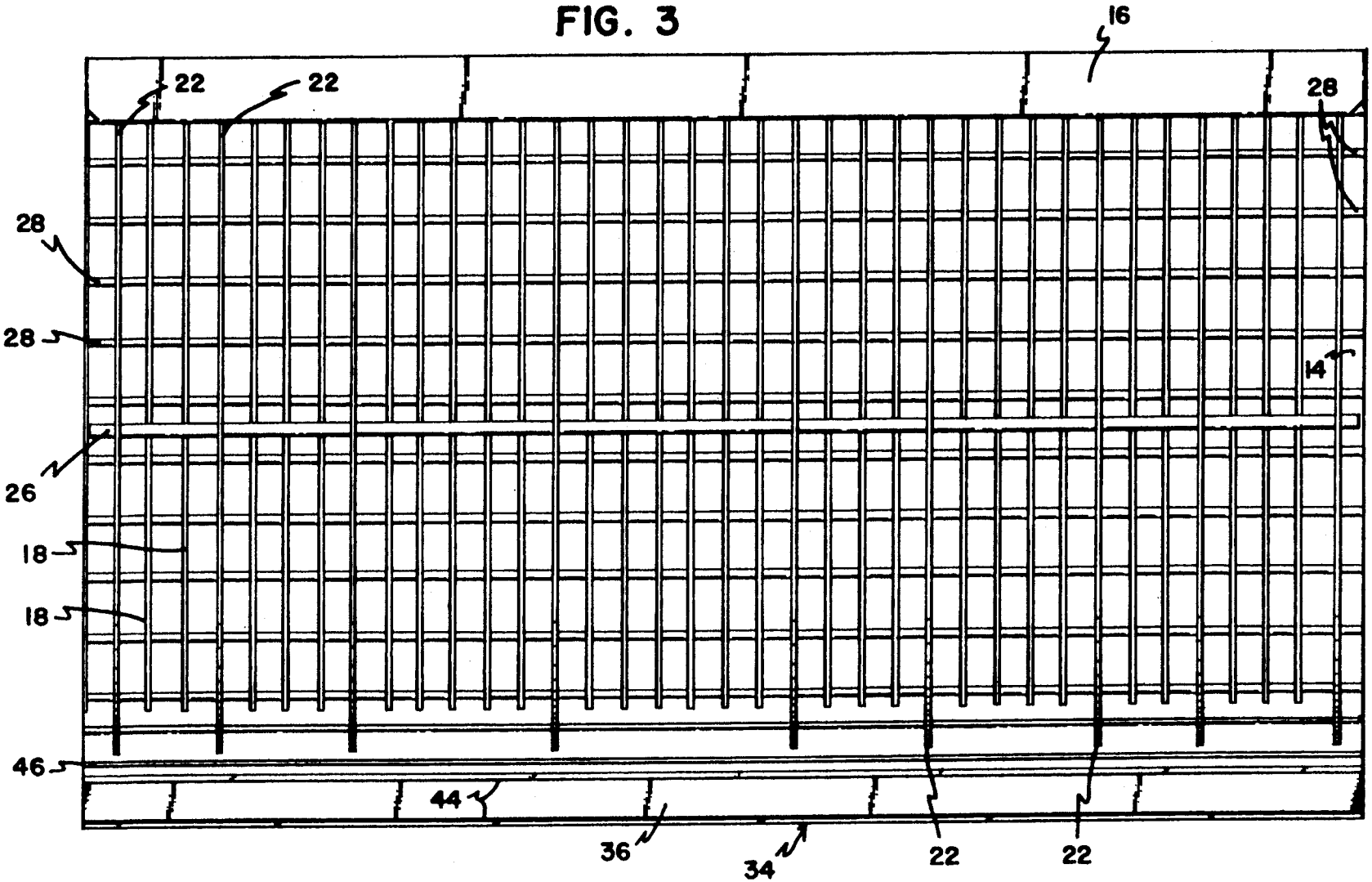
FIG. 3 is a top plan view of the merchandise display system of FIG. 1.
Figure 4:
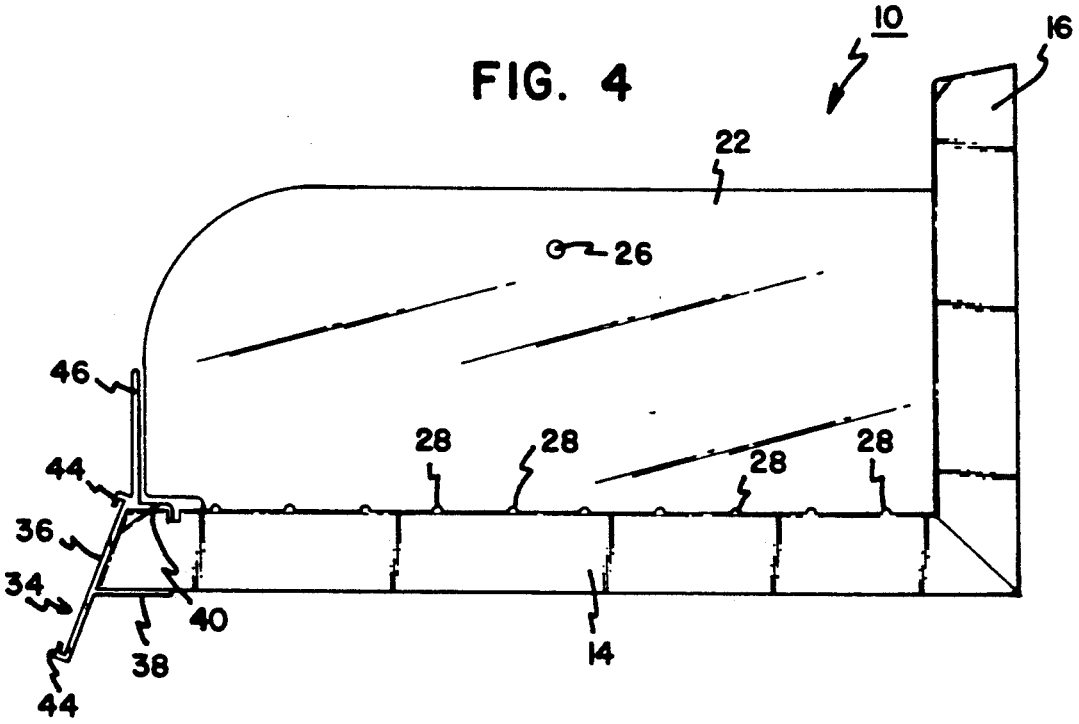
FIG. 4 is a right side elevation view of the merchandise display system of FIG. 1.
Figure 8:
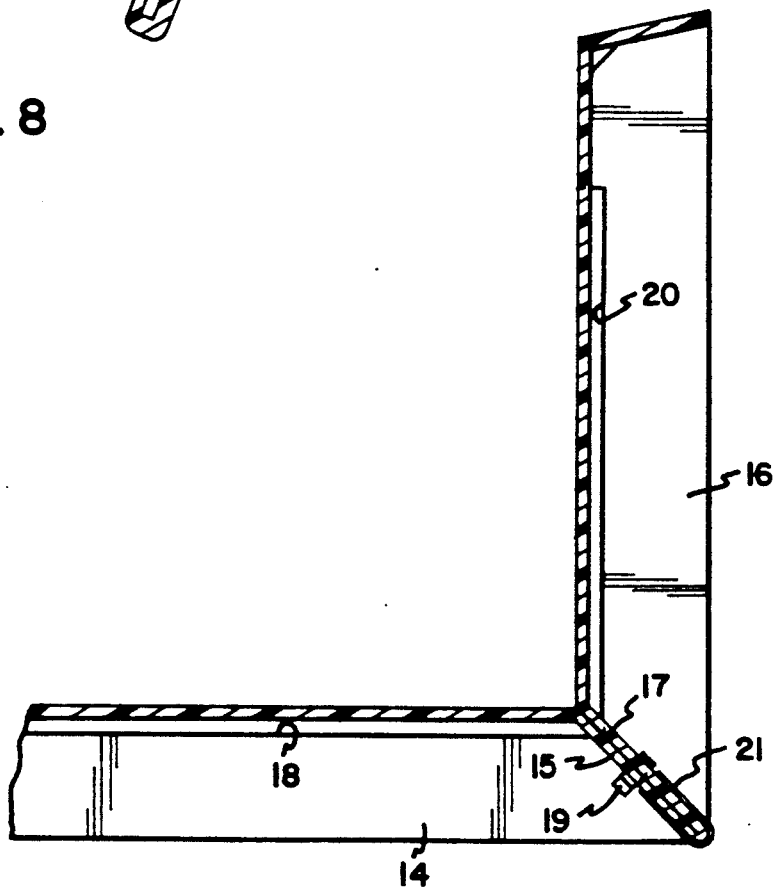
FIG. 8 is an enlarged cross-sectional view showing attachment of a back member and base member of the merchandise display system of FIG. 1.
Figure 10:
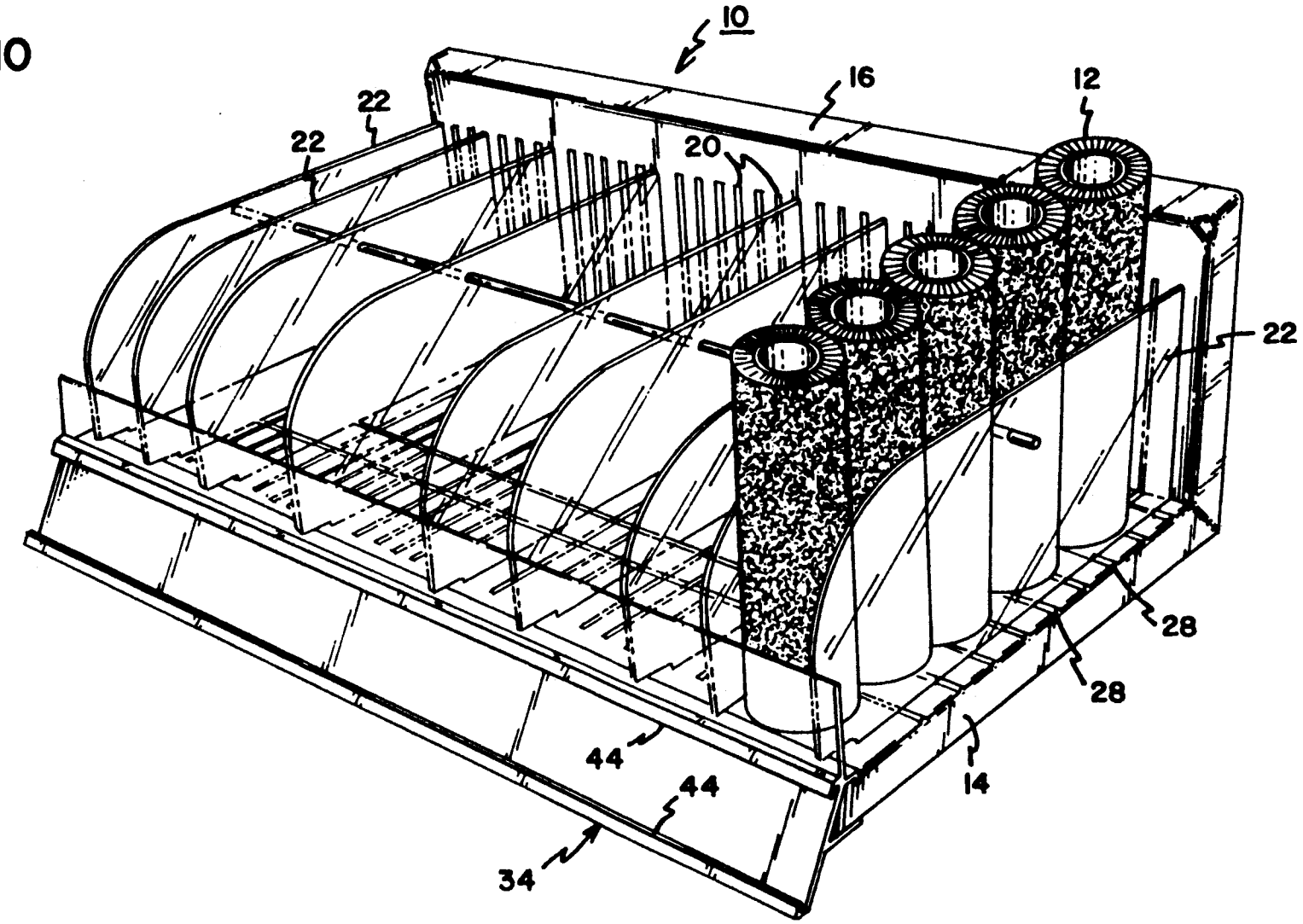
FIG. 10 is a perspective view of the merchandise display system of FIG. 1 showing a product disposed within the system.

Referring now to the several drawing Figures in which identical elements are numbered identically throughout a description of the preferred embodiment will now be provided with reference to a merchandise display system 10. A plurality of systems 10 may be placed side-by-side for the purposes of displaying a product 12 (see FIG. 10 where the display product is a paint roller). As shown in FIG. 1, the merchandise display system 10 includes a base member 14 and a back member 16. The base member 14 has a first plurality of parallel spaced apart slots 18 formed therein. The back member 16 has a second plurality of slots 20 formed therein. The base member 14 and back member 16 are provided with angular connection surfaces 15 and 17 (see FIG. 8) which are abutted together and secured with staples 19, tape 21 or any other suitable connection means to join base member 14 and back member 16 in a generally right-angled configuration. With the base member 14 and back member 16 joined, the base member 14 is generally horizontal, back member 16 is generally vertical and slots 20 are aligned with slots 18.

Figure 5:
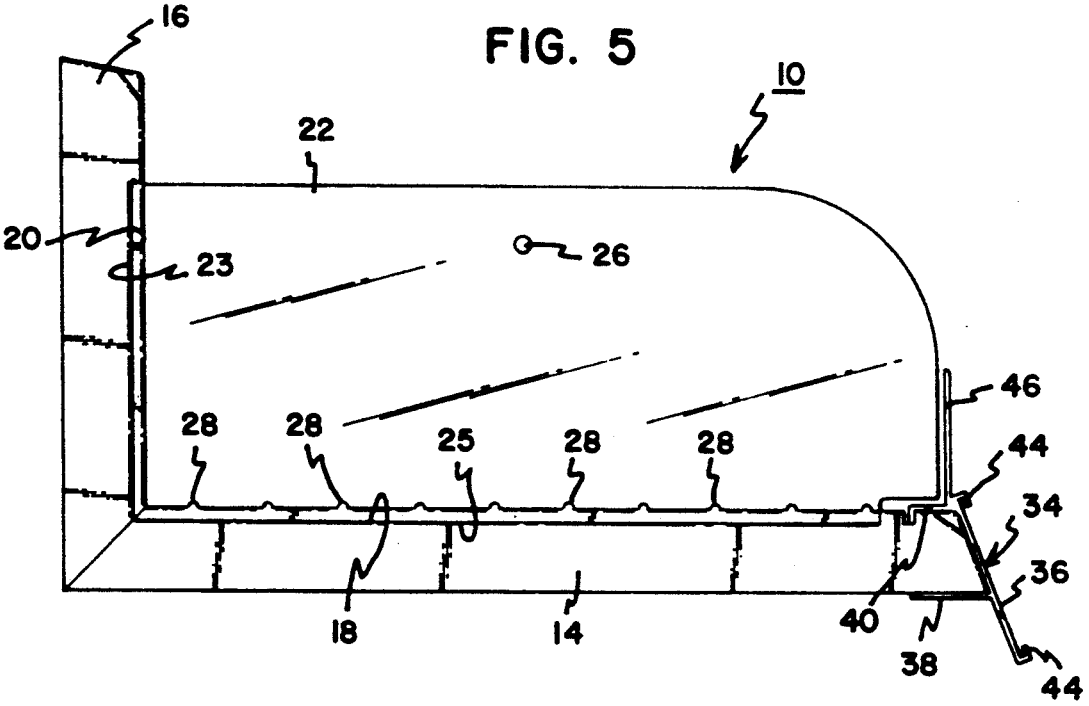
FIG. 5 is a left side elevation view of the merchandise display system of FIG. 1.

A plurality of clear plastic dividers 22 are provided each having a rear edge 23 and a bottom edge 25 (see FIG. 5). Dividers 22 are secured to merchandiser 10 with edge 25 received within slots 18 and with edges 23 received within slots 20. So connected, each of the dividers 22 is arranged in a generally vertical plane and in parallel alignment with all other dividers 22. A hole 24 is formed through each divider such that the holes 24 are aligned when the dividers 22 are secured to the merchandiser 10. A rod 26 (see FIG. 1) is received through each of the holes 24.

The base 14 is provided with a plurality of ridges which protrude upwardly from base 14 and extend generally transverse to the direction of the slots 18. The ridges 28 help retain a product 12 within the merchandiser 10 to prevent the product from slipping on the upper surface of base 14. In the event the merchandiser is not completely full, the rod 26 permits a store manager to give the appearance of a full merchandiser 10 by simply placing the product 12 on the forward side of the rod 26.

Figure 7:
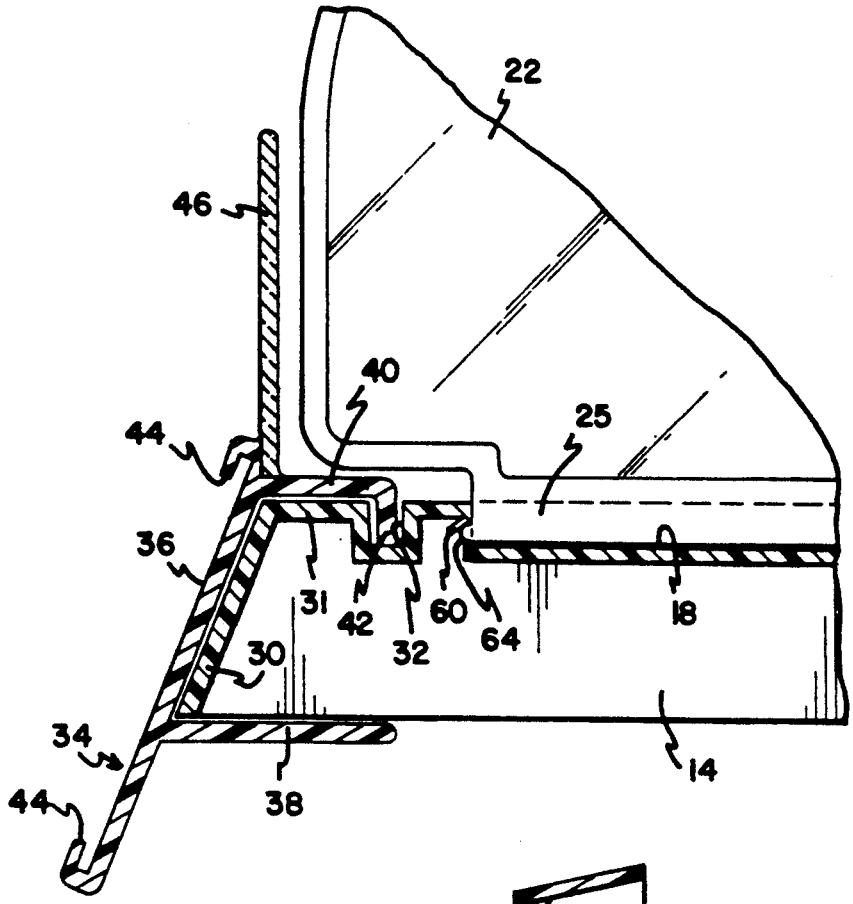
FIG. 7 is an enlarged cross-sectional view of a forward portion of the merchandise display system of FIG. 1 showing a divider secured to the merchandise display system.

With best reference to FIGS. 1 and 7, base 14 has a leading edge 30. Adjacent leading edge 30, the upper surface 31 of base member 14 is provided with a transverse slot 32.

An extruded display edger 34 is carried on leading edge 30. Edger 34 includes a flat surface 36 sized to cover surface 30. A lower retaining rib 38 extends from surface 36 beneath base member 14. An upper retaining rib 40 extends generally parallel to rib 38 above surface 31. Rib 40 terminates at a downwardly projecting flange 42 which is sized to be received within slot 32. As a result, edger 34 may be slid onto the forward end 30. Forward surface 36 is provided with upper and lower clips 44 so that a decorative display sign (not shown) may be carried on surface 36 and received within clips 44.

Display edger 34 also includes a vertically extending forward wall 46 formed of clear plastic which extends upwardly from edger 34 in front of dividers 22 as best shown in FIGS. 1 and 7. Wall 46 prevents product from falling forward out of the display system 10 while the clear plastic of wall 46 permits the unobstructed viewing of product 12 contained within the merchandise display system 10.

The clear plastic wall 46 and the remainder of the opaque plastic edger 34 are simultaneously extruded to according to known extrusion techniques.

Figure 6:
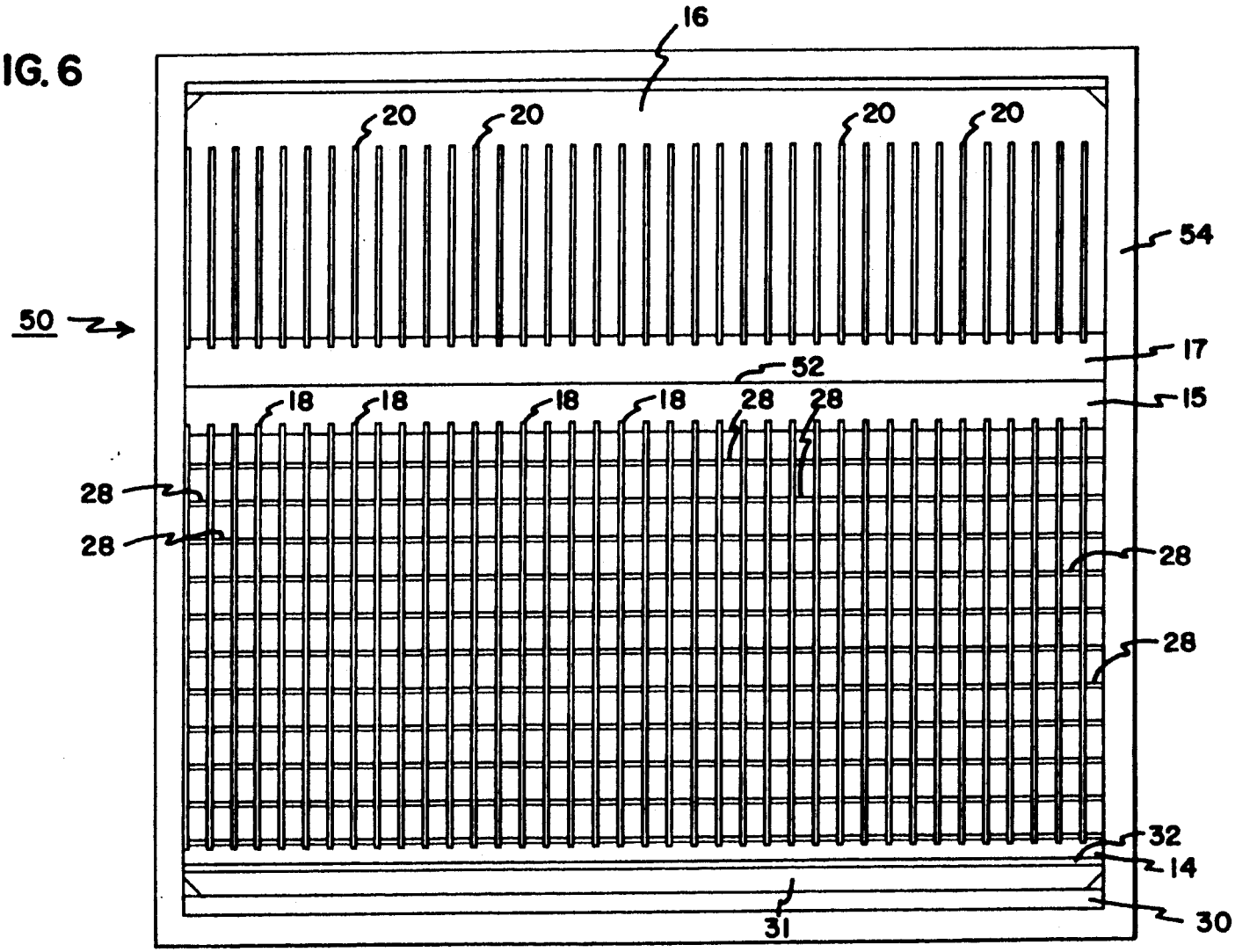
FIG. 6 is a top plane view of a vacuum-formed blank used in forming the merchandise display system of FIG. 1.

Preferably, the base member 14 and back member 16 are simultaneously formed through well known vacuum or pressure forming techniques. Specifically, the base member 14 and back member 16 are formed from the same generally horizontal or flat blank 50 shown in FIG. 6. As shown in FIG. 6, the base member 14 and back member 16 are formed in a generally co-planar configuration joined at a score line 52. As a result of the vacuum or pressure forming technique, a peripheral flange 54 surrounds the outer periphery of the base member 14 and back member 16.

After the blank 50 is formed, the flange 54 is trimmed off and discarded as waste. A score is made along score line 52 and back member 16 is bent upwardly for surface 17 to abut surface 15.

As a result of the vacuum or pressure forming technique, the vertical surfaces of the blank 50 (i.e., the surfaces formed in the direction of the pressure or vacuum) are generally thinner than the horizontal surfaces. This occurrence is well known in vacuum or pressure forming. Applicants used this variation in thickness for the purposes in providing a mechanism to lock dividers 22 into the merchandiser 10.

Figure 9:
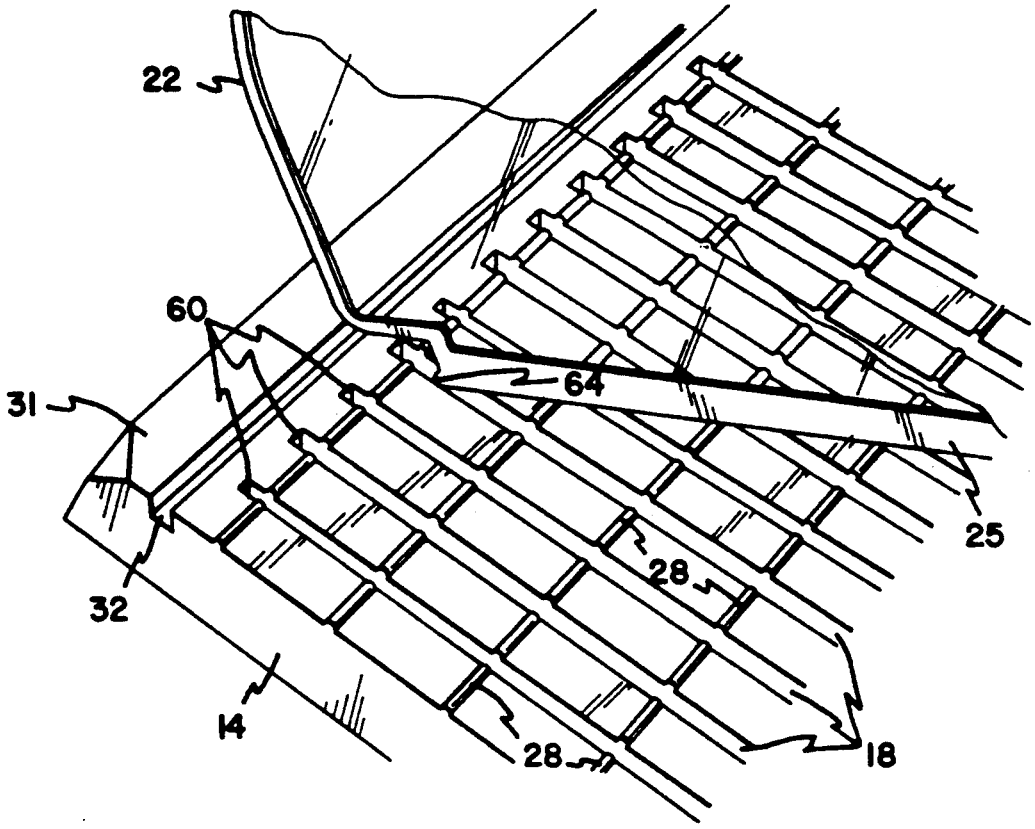
FIG. 9 is a perspective view showing insertion of a divider into the merchandise display system of FIG. 1.

With best reference to FIG. 9, each of the slots 18 terminates at a vertical wall segment 60 at the leading edge of the slot. A leading end 62 of the lower edges 25 of dividers 22 are provided with a wall piercing protrusion 64. As shown in FIG. 9, the divider 22 is inserted by aiming the protrusion 64 against surface 60 and forcing edge 25 into slot 18. Simultaneously, rear edge 23 is forced into slot 20. When the divider 22 is inserted in place, protrusion 64 pierces wall segment 60 (as shown in FIG. 7) with the protrusion locking the divider 22 in place. This provides a significant advantage over prior art merchandisers. Dividers of prior art merchandisers are constantly being bumped and jostled by customers who are removing or replacing product in the merchandiser. As a result of this contact, the dividers 22 can become dislodged. The locking action of protrusion 64 keeps dividers 22 in place even if being knocked about by users of the merchandiser.

With the merchandise display system 10 completed, the merchandiser can be placed on a shelf with base member 14 resting directly on a shelf. Alternatively, the merchandiser 10 may be hung on a pegboard. For pegboard usage, a wire cradle (not shown) may be attached to the peg board with base member 14 disposed on the wire cradle for bottom support. Due to the vacuum or pressure forming technique, the material of base member 14 and back member 16 are generally weak. Accordingly, it may be desirable to add a styrofoam block or other support beneath base member 14 for structural support.

Having described the present in the preferred embodiment, it has been shown how the objects of the present invention have been obtained. However, modification and equivalents of the disclosed concepts, such as those which will readily to one skilled in the art, are intended to be included with the scope of the appended claims.

We claim:

1. A merchandise display system comprising:

a base member having a transverse and a longitudinal dimension and a first plurality of divider receiving slots formed therein, said first plurality being generally parallel and extending across said transverse dimension from a trailing edge of said slots of said first plurality to a leading edge, said base member having a solid vertical surface opposing each of said slots at said leading edge;

a back member having a second plurality of divider receiving slots formed therein;

said base member connected to said back member at said trailing edge and with said base member generally horizontal and said back member generally vertical, and with said first and second plurality of slots aligned to define complete divider receiving slots;

a plurality of dividers each having a bottom edge and a rear edge with said bottom edges sized to be received within said first plurality of slots and said rear edges sized to be received within said second plurality of slots;

said base member having means defining a plurality of generally vertical forward wall segments at a leading edge of each said first plurality of slots;

each of said dividers including lock means at a leading end of said bottom edges to lock said dividers to said base member upon insertion of said divider in said base member, said lock means including a piercing member at said leading end, said lock member projecting generally horizontally and sized to break and pierce through said vertical surface of said base member upon insertion of said divider into one of said plurality of slots.

2. A merchandise display system according to claim 1 wherein said base member is provided with a forward edge, a display edger sized to be received on said forward edge is provided with means for retaining said edger on said forward edge.

3. A merchandise display system according to claim 2 wherein said display edger includes a transparent wall extending upwardly from said edger on a forward side of said dividers.

4. A merchandise display system according to claim 2 wherein said display edger includes means for receiving and retaining a display sign.

5. A merchandise display system according to claim 1 further comprising means formed on upper surface of said base member for preventing slippage of a product on said upper surface.

6. A merchandise display system according to claim 1 further comprising a transverse divider extending between said dividers.

7. A merchandise display system according to claim 6 wherein said transverse divider is a rod extending through each of said dividers.

8. A merchandise display system comprising:

a base member having a first plurality of divider receiving slots formed therein;

a back member having a second plurality of divider receiving slots formed therein;

said base member connected to said back member with said base member generally horizontal and with said back member generally vertical, and with said first and second plurality of slots aligned to define complete divider receiving slots;

a plurality of dividers each having a bottom edge and a rear edge with said bottom edges sized to be received within said first plurality of slots and said rear edges sized to be received within said second plurality of slots;

said base member having a leading edge including a forward surface and a top surface with a longitudinal groove disposed in said top surface, a display edger sized to be received on said leading edge, said display edger having a forward face sized and disposed to oppose said forward surface, said display edger also having a longitudinal flange connected to said forward face and sized to be received within said groove;

said display edger including a transparent wall extending upwardly from said edger on a forward side of said dividers and sign retaining means for receiving and retaining an display sign, said sign retaining means including groove defining surfaces for receive an edge of a display sign.

9. A merchandise display system according to claim 1 wherein said vertical surface of said base member is a reduced thickness portion of said base member, said lock member including a piercing tab on said leading end and sized to penetrate through said reduced thickness portion upon insertion of said divider within one of said complete divider receiving slots.

* * * * *